US005803515A

United States Patent [19]

Arabia, Jr. et al.

[11] Patent Number: 5,803,515

[45] **Date of Patent: *Sep. 8, 1998**

[54] VEHICLE DOOR LATCH

[75] Inventors: Frank Joseph Arabia, Jr., Macomb Township; Colby Lenn Bellew, Troy; Ian Martin, Pontiac; Joseph Michael Johnson, Huntington Woods, all of Mich.

[73] Assignee: General Motors Corporation, Detroit, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 707,467

[22] Filed: Sep. 4, 1996

[51] Int. Cl.[6] ..... E05C 3/06

[52] U.S. Cl. ..... 292/216; 292/201; 292/DIG. 27

[58] Field of Search ..... 292/216, DIG. 23, 292/DIG. 27, 201, 336.3; 70/264

[56] References Cited

U.S. PATENT DOCUMENTS

| | | | |
|---|---|---|---|
| 3,858,919 | 1/1975 | Kleefeld et al. | 292/216 |
| 4,364,249 | 12/1982 | Kleefeldt | 292/DIG. 23 X |
| 4,756,563 | 7/1988 | Garwood et al. | 292/216 |
| 4,974,886 | 12/1990 | Kleefeldt et al. | 292/216 X |
| 5,046,341 | 9/1991 | Ogino et al. | 70/264 |
| 5,054,827 | 10/1991 | Konchan et al. | 292/216 |
| 5,454,608 | 10/1995 | Dzurko et al. | 292/216 |
| 5,603,537 | 2/1997 | Amano et al. | 292/DIG. 23 X |
| 5,715,713 | 2/1998 | Audry et al. | 70/264 X |

FOREIGN PATENT DOCUMENTS

| | | | |
|---|---|---|---|
| 0634547 | 7/1994 | European Pat. Off. | E05B 65/32 |
| 72816 | 6/1979 | Japan | 292/216 |
| 2228524 | 8/1990 | United Kingdom . | |

*Primary Examiner*—Rodney M. Lindsey
*Attorney, Agent, or Firm*—Charles E. Leahy

[57] ABSTRACT

A vehicle door latch is provided having unlock latched and unlatched positions, the door latch having at least one locking/unlocking actuator for moving the latch between locked latched and unlocked latched positions, and the door latch having a freewheeling transfer lever operatively connected to at least one release handle, the transfer lever being provided for moving the door latch to the unlatched position. The door latch has a feature to allow the locking/unlocking actuator to move the latch from the locked latched position to the unlocked latched position while the door release handle is previously or simultaneously actuated, by subsequent release of the door release handle without reactivation of the locking/unlocking actuator.

3 Claims, 7 Drawing Sheets

VEHICLE DOOR LATCH

TECHNICAL FIELD

This invention relates to vehicle door latches.

BACKGROUND OF THE INVENTION

Automotive vehicles have a door latch on each vehicle door to latch the door in the closed position. Each vehicle door latch includes a lock that is commonly actuated from inside the vehicle by a readily accessible sill button or other manually operable device on the door. The vehicle door lock for the front doors is conventionally operated from outside the vehicle as well, usually by a key lock cylinder that has a removable key to deter theft.

Upscale automotive vehicles commonly employ a power lock system as a convenience feature. The power lock system commonly employs an electrically powered actuator associated with each door latch (and sometimes also with the trunk latch and fuel filler door latch) to move the door lock between its locked and unlocked positions. The actuators are controlled in a variety of ways. In a central vehicle door lock system, or at least in the American version of such a system, all the actuators are controlled by any one of three switches. These three switches are located in the key lock cylinder for the driver's door and on the interior trim panel for each front door. Thus, all doors can be locked or unlocked from outside the vehicle by means of the key lock cylinder switch in the driver's door, or from inside the vehicle by means of the switches next to the driver or the front seat passenger.

To protect the components of the door latch, most door latches are of the freewheeling type. When a door latch is of the freewheeling type, the door latch in the locked position does not exert any resistance to actuation of a given door interior or exterior release handle. However, most freewheeling door latches are configured in such a manner that if the latch is in a locked position, the door latch cannot be unlatched if the door release handle is previously or simultaneously actuated.

In a typical situation, a driver will stop the vehicle to pick up a potential passenger. A safety conscious driver will have the door latch in the locked position. After the driver stops the vehicle, the potential passenger, unaware of locked position of the door latch (before being requested to do so by the vehicle operator) will pull on the exterior release handle. Subsequently or simultaneously, the driver will attempt to unlock the passenger side door (manually or by power actuation) but will not be able to do so since the release handle is pulled.

The driver will instruct the potential passenger to let go of the door release handle. After the potential passenger lets go of the door release handle, the driver will have to again actuate the latch to unlock it. Thereafter, the potential passenger may pull on the door release handle and enter the vehicle.

SUMMARY OF THE INVENTION

The present invention brings forth a freewheeling door latch which will allow an outside potential passenger in the above noted situation to unlatch a vehicle door by release of the vehicle door handle and a subsequent pull on a door release handle without the driver having to unlock the door latch a second time. The above noted feature is provided by a special two-part locking lever. The two-part locking lever allows the vehicle latch to go into an unlocked position upon one actuation regardless of a previous or simultaneous pull on a door release handle.

DESCRIPTION OF THE INVENTION

Figure 7:
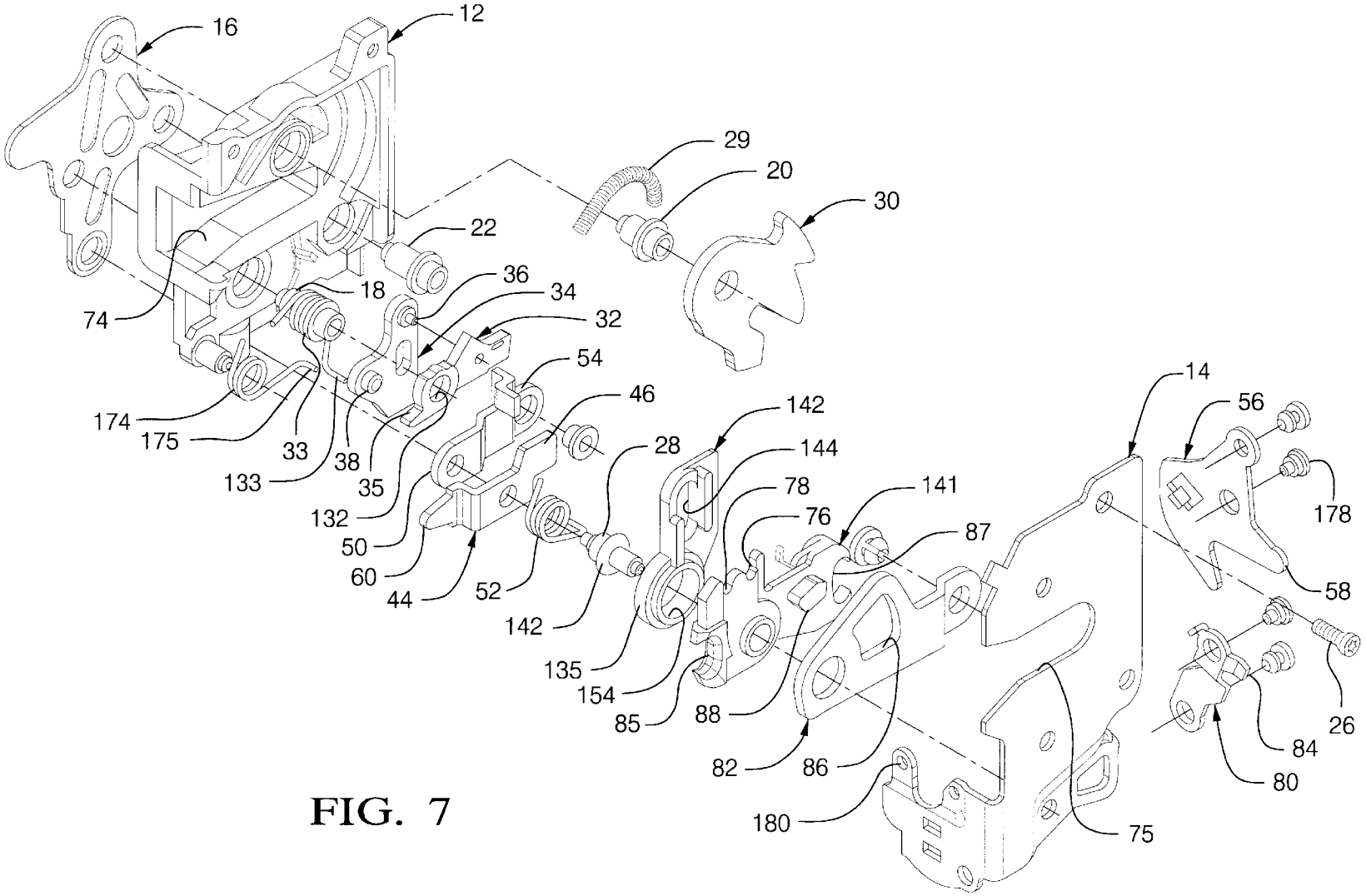
FIG. 7 is an exploded perspective view of the vehicle door latch shown in FIGS. 1 through 6.

Referring now to the drawings, and more particularly to the exploded perspective view of FIG. 7, the vehicle door latch 7 is the same basic arrangement as the vehicle door latches that are disclosed in U.S. Pat. No. 4,756,563 granted to Stephen L. Garwood and Jeffrey Konchan Jul. 12, 1988, for a vehicle door latch and U.S. Pat. No. 5,054,827 granted to Jeffrey L. Konchan and Jiri Paulik Oct. 8, 1991, for a vehicle door latch. The vehicle door latch 7 is also very similar to the door latch disclosed in U.S. Pat. No. 5,454,608 granted to Thomas A. Dzurko, Frank J. Arabia, Jr., and Ian Martin Oct. 3, 1995.

The vehicle door latch 7 has a three piece enclosure that comprises a plastic housing 12, a metal face plate 14 and a metal back plate 16. The plastic housing 12 and the metal back plate 16 are held together by three flanged, internally threaded bushings 18, 20 and 22, that are inserted into three holes in the plastic housing 12, then through three aligned holes in the back plate 16 and then flanged over the back plate. The metal face plate 14 has three bolt holes 24 that are aligned with the bushings 18, 20 and 24 when the metal face plate is attached to the plastic housing 12 by a screw 26. The metal face plate 14 and the metal back plate 16 have lower portions below the plastic housing 12 that are held together by a flanged stud 28 that has projecting pins at each end that are inserted in holes in the plates and peened over, headed over or headed with a fastener.

LATCHING MECHANISM

Figure 1:
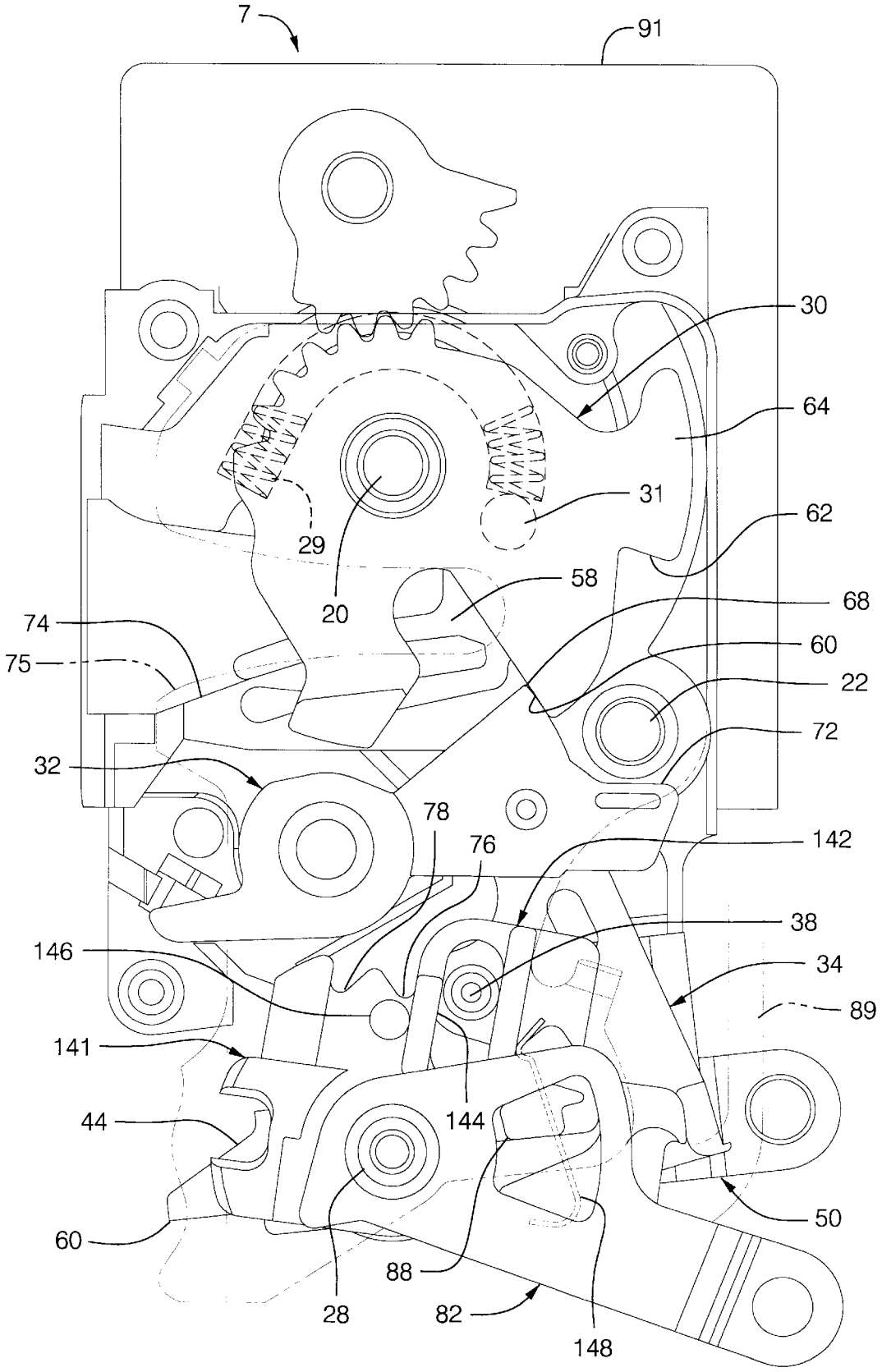
FIG. 1 is a front elevational view of a preferred embodiment of a vehicle door latch according to the present invention showing the latch in a locked and latched position.
Figure 2:
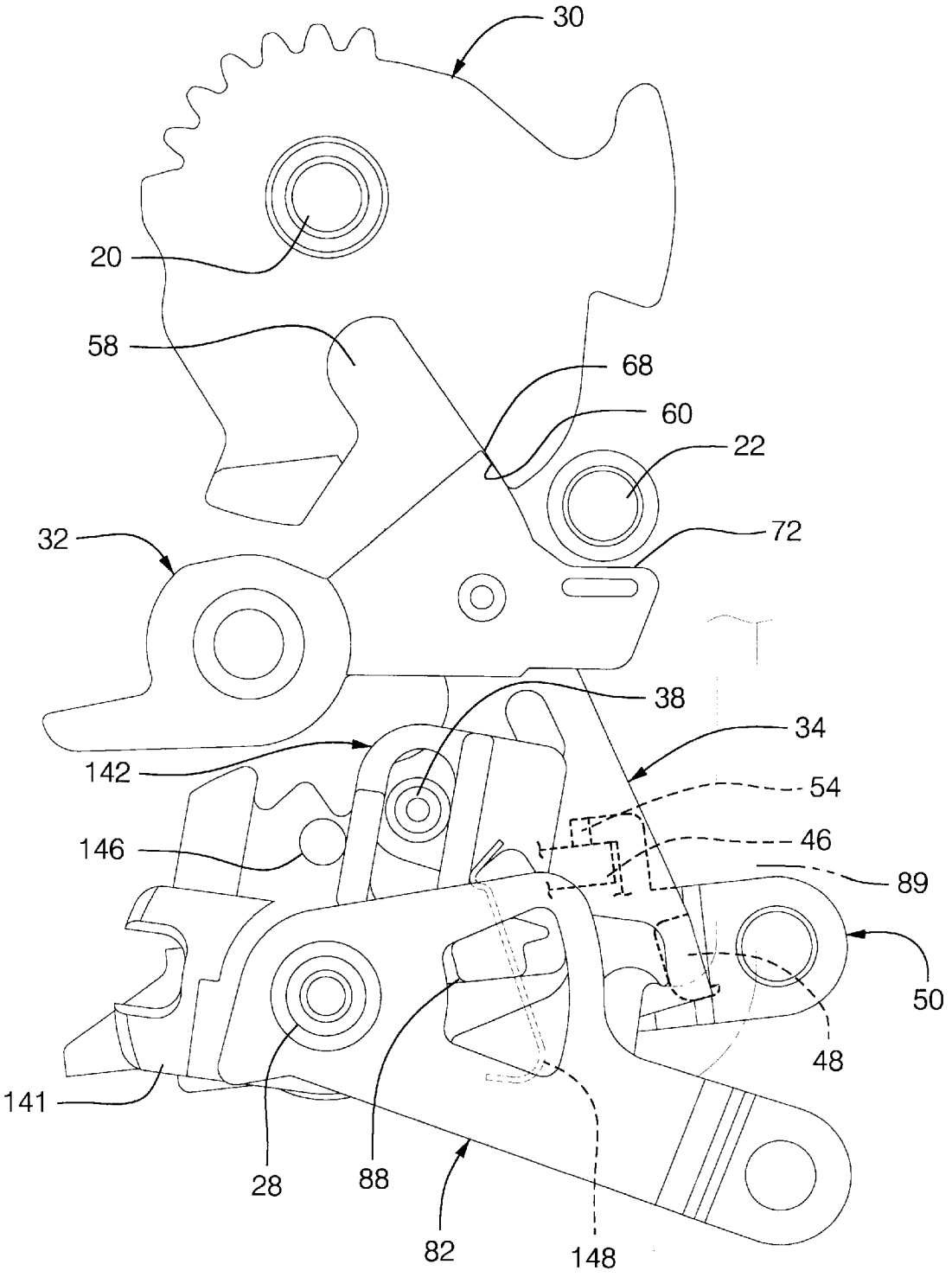
FIG. 2 is a view similar to that of FIG. 1 with various components removed for clarity of illustration to show further details of a fork bolt lever, detent lever, intermittent lever, transfer lever, operating lever, outside lock operating lever, and a two-part locking lever which provides the essence of the present invention.

The latching mechanism of the vehicle door latch 7 comprises a fork bolt lever 30 and a cooperating detent lever 32 that are pivotally mounted on bushings 20 and 18, respectively, and located in a chamber of the plastic housing 12 behind the metal face plate 14. The fork bolt lever 30 is biased clockwise by a coil spring 29. The coil spring 29 is disposed in a curved slot in the plastic housing 12 behind the fork bolt lever 30 and engages a depending pin 31 (FIG. 1) of the fork bolt lever 30 at one end. The detent lever 32 is biased counterclockwise into engagement with the fork bolt lever 30 by a coil spring 33 that surrounds the bushing 18 and that has one end 133 engaging the plastic housing 12 and the other end engaging an ear 35 of the detent lever 32. The detent lever 32 engages the fork bolt lever 30 in the fork bolt levers latched position as shown in FIGS. 1 and 2. The detent lever the fork bolt lever 30 in full latched position against the counterclockwise bias of the spring 29. The operation is explained more fully below.

The latching mechanism further comprises an intermittent lever 34 for operating the detent lever 32. The intermittent lever 34 is located in chamber of the plastic housing 12 behind the detent lever 32. It has two integral pivot pins 36 and 38. Pivot pin 36 is journalled in a hole in the detent lever 32 so that the detent lever 32 rotates clockwise from the position shown in FIG. 3 and out of latched engagement with the fork bolt lever 30 when the intermittent lever 34 is pulled down. This allows the fork bolt lever 30 to rotate counterclockwise to an unlatched position when the vehicle door is opened.

Figure 3:
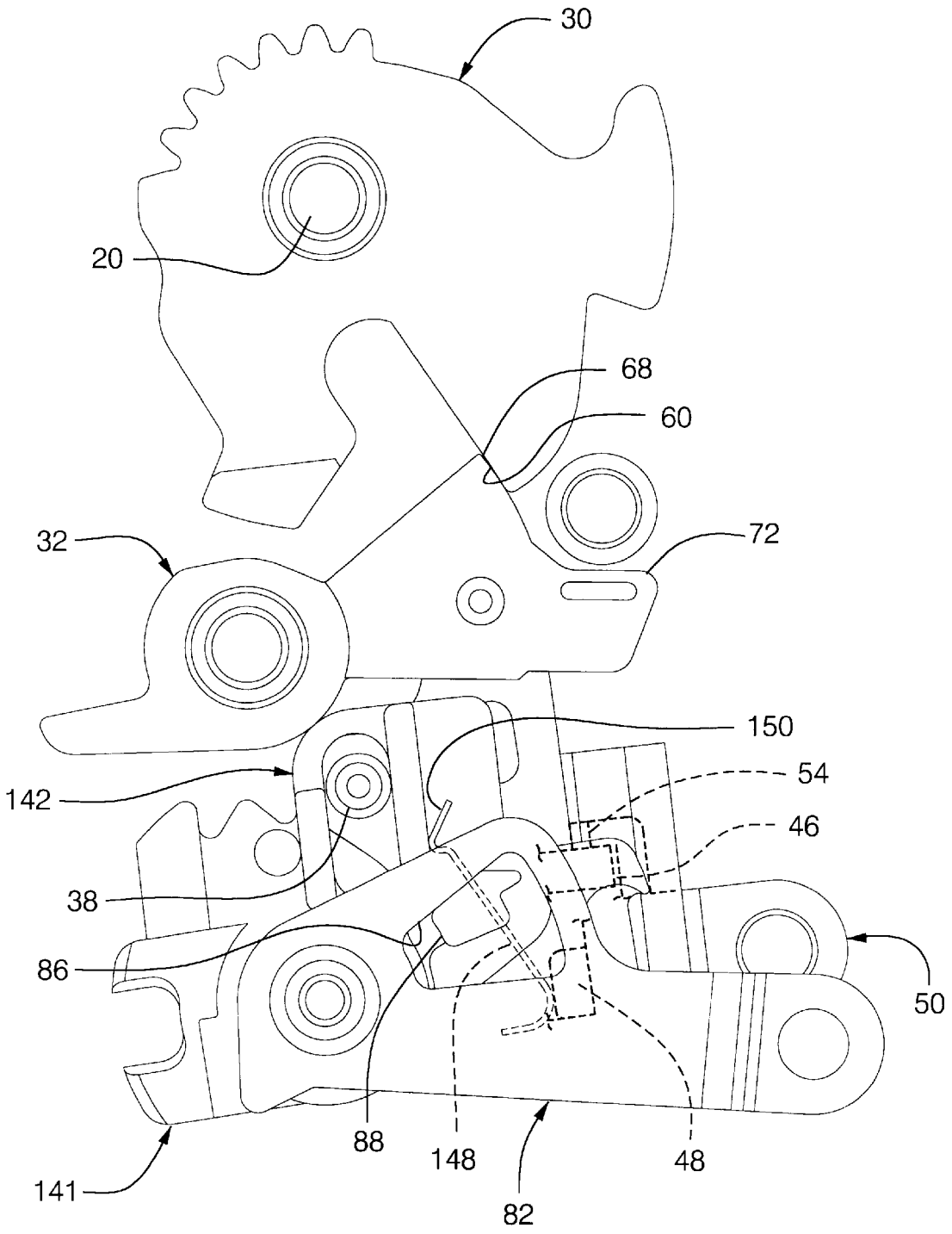
FIG. 3 is an operational view similar to that of FIGS. 1 and 2 showing the vehicle door latch in FIGS. 1 and 2 in an unlocked and latched position.

The second pivot pin 38 is disposed in a slot 144 of a plastic second locking lever part 142 so that the second locking lever part 142 pivots the intermittent lever 34 counterclockwise about pivot pin 36 when the second locking lever part 142 is rotated clockwise from the latched unlocked position shown in FIG. 3 to the latched locked position shown in FIG. 2. The second locking lever part 142 is journalled on the stud 28 between a flange 42 and a first locking lever part 141.

The second locking lever part 142 cooperates with a plastic first locking lever part 141 that is journalled on the stud 28 between the second locking lever part 142 and the face plate 14. The first locking lever part 141 normally drives the second locking lever part 142.

The locking lever parts 141 and 142 are shown in detail in FIG. 6, and the operation of the locking lever parts 141 and 142 is explained in greater detail below in connection with the description of the locking mechanism. These two locking lever parts 141 and 142 fit in essentially the same space as the single locking lever of U.S. Pat. Nos. 4,756,563, 5,054,827 and the double part locking lever of U.S. Pat. No. 5,454,608. Yet, these two locking lever parts 141 and 142 cooperate to provide features not possible with the single or double part locking levers of the prior art as indicated above.

The latching mechanism further comprises a transfer lever 44 that is journalled on a reduced diameter portion of the stud 28 spaced rearwardly of the flange 42. The transfer lever 44 has an ear 46 at one end that is engageable with an integral, rearwardly projecting tab 48 (FIGS. 3 and 5) of the intermittent lever 34, so that the intermittent lever 34 is pulled down when the transfer lever 44 is rotated clockwise from the position shown in FIG. 3.

The latching mechanism further comprises an outside operating lever 50 and a coil return spring 52. The outside operating lever 50 is also journalled on the reduced diameter portion of the stud 28 behind the transfer lever 44. It has a bent tab 54 that engages the ear 46 of the transfer lever 44 so that the outside operating lever 50 rotates the transfer lever 44 clockwise when it is rotated clockwise on stud 28. The outside operating lever 50 is connected by suitable linkage for rotation by an outside door release handle (not shown).

The coil return spring 52 is disposed around the stud 28 and located between the flange 42 and the transfer lever 44. One end of the coil spring 52 engages the bottom of transfer lever 44, and the other end engages the bottom of the plastic housing 12 above the transfer lever 44, so that the transfer lever 44 and outside operating lever 50 are biased counterclockwise to a rest position where tab 54 engages the bottom of the plastic housing 12.

The latching mechanism further comprises an inside operating lever 56 that is pivotally mounted on a flange of the metal face plate 14 via a pin 178 inserted within a hole 180. The inside operating lever 56 has a tab 58 that engages a second ear 60 of the transfer lever 44 so that the inside operating lever also rotates the transfer lever 44 clockwise when it is rotated counterclockwise. The inside operating lever 56 is connected by suitable linkage for rotation by an inside door release handle (not shown).

Referring now to FIGS. 1 and 2, the fork bolt lever 30 has a conventional slot or throat 58 for receiving and retaining a striker member, such as that shown in the U.S. Patents discussed above, that is attached to the door pillar to latch the door in the closed position (not shown). The fork bolt lever 30 also includes a primary latch shoulder 60, an intermediate latch shoulder 62 and a radially projecting foot 64. The fork bolt lever 30 also has a plastic coating (not shown) that covers a surface of the slot 58 that is engaged by the striker for energy absorption and quiet operation when the vehicle door is slammed shut.

The detent lever 32 has a sector shaped catch 68 that positively engages the primary latch shoulder 60 to hold the fork bolt lever 30 in the locked and latched position, as shown in FIGS. 1 and 2. The detent lever 32 also holds the fork bolt lever 30 in the unlocked and latched position of FIG. 3. The sector shaped catch 68 also positively engages an intermediate latch shoulder 62 to hold the fork bolt lever 30 in an intermediate latched position rotated counterclockwise from the full latched position shown in FIGS. 1, 2 and 3. On the other hand the sector shaped catch 68 rests on the radially projecting foot 64 when the fork bolt lever 30 is released and rotated to an unlatched position (FIG. 5) still further counterclockwise from the full latched position shown in FIGS. 1, 2 and 3.

The detent lever 32 also has a slotted portion 122 that provides an integral bumper 72. The bumper 72 engages the bushing 22 to stop counterclockwise pivoting of the detent lever 32 under the bias of spring 52. This bumper 72 also absorbs energy and quiets operation when the door is slammed shut.

The latching mechanism operates as follows. When the door latch 10 is in an unlatched and unlocked condition (FIG. 5), the fork bolt lever 30 is poised to receive a conventional striker (not shown) that projects into aligned fishmouth slots 74 and 75 of the plastic housing 12 and the metal face plate 14 when the door is shut. The entering striker engages at the back of the throat 58 and rotates the fork bolt lever 30 counterclockwise against the bias of spring 29 until the fork bolt lever 30 is rotated to the full latch position shown in FIG. 3, where the fork bolt lever 30 captures the striker in the throat 58. The fork bolt lever 30 is held in the full latch position by the catch 68 of the detent lever 32 engaging the primary latch shoulder 60 of the fork bolt lever 30.

The catch 68 rides along the periphery of the fork bolt lever 30 under the bias of spring 52 as the fork bolt lever 30 rotates counterclockwise from the unlatched position to the full latch position. During this travel, the catch 68 rides under the foot 64 into engagement with the intermediate latching shoulder 62 and then with the primary latching shoulder 60. It is to be noted that the engagement of the catch 68 with the intermediate latching shoulder 62 is sufficient to hold the vehicle door closed in the event that the vehicle door is not shut completely so that the catch 68 engages the primary latch shoulder 60.

Figure 5:
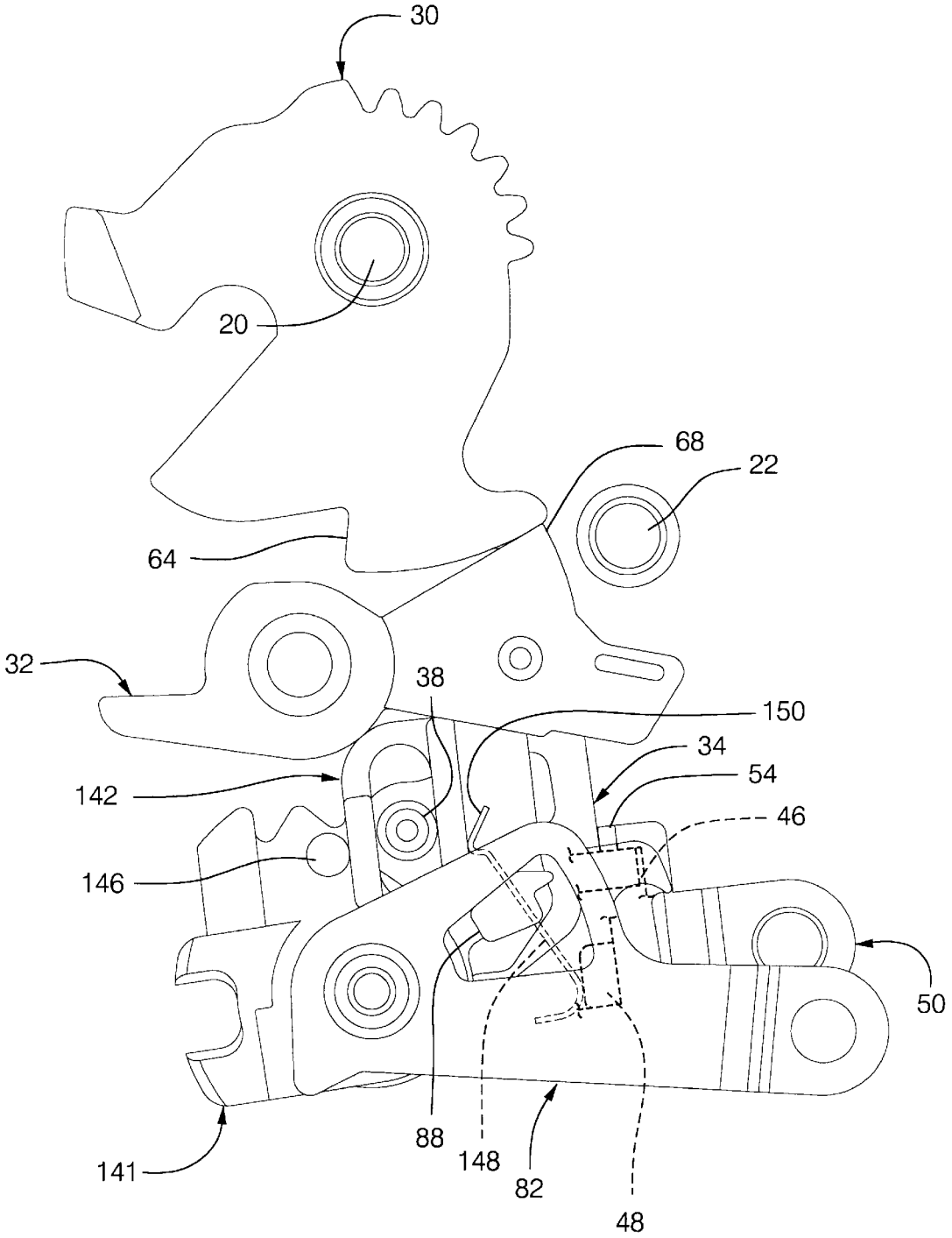
FIG. 5 is a view similar to that of FIGS. 2 through 4, showing the vehicle latch of the present invention in the unlocked and unlatched position.

If the vehicle door latch 7 is unlocked and latched (FIG. 3), so that the vehicle door can be opened by operating either the inside or the outside door release handles (not shown) to rotate the transfer lever 44 clockwise and the ear 46 down from the position shown in FIG. 3. The ear 46 engages rearward projecting tab 48 of intermittent lever 34 and pulls the intermittent lever down from the full latch position shown in FIG. 3, to an unlatch position (FIG. 5). As the intermittent lever 34 is pulled down, it rotates the detent lever 68 clockwise against the bias of the spring 52 from the latch position shown in FIG. 3, to an unlatch position (FIG. 5) where the catch 68 clears the latch shoulders 60 and 62. The fork bolt lever 30 is then free to rotate counterclockwise under the bias of spring 29 from the full latch position shown in FIG. 3, to an unlatch position as the striker is pulled out of the aligned fishmouth slots 74 and 75 when the vehicle door is opened.

LOCKING MECHANISM

Returning to FIG. 5, the vehicle door latch 7 includes a freewheeling type lock mechanism for disconnecting the latching mechanism so that operation of either the inside door release handle or the outside door release handle is ineffective in unlatching the, detent lever 32. The lock mechanism comprises the locking lever parts 141 and 142 that are pivotally mounted on the stud 28 between the flange 42 and the metal face plate 14. As indicated above, the second locking lever part 142 is also connected to the intermittent lever 34 by a pin and slot arrangement that allows these two parts relative movement (translational and pivotal) with respect to each other.

The second locking lever part 142 pivots on the stud 28 between an unlocked position shown in FIG. 3, and a locked position shown in FIG. 2. The second locking lever part 142 is held in the unlocked position by the first locking lever part 141 which, in turn, is held in the unlocked position by a coil spring 174 that has one arm 175 mounted on the plastic housing 12 and the other end engaging a first detent notch 76 in the first locking lever part 141. The plastic first locking lever part 141 pivots clockwise from this unlocked position shown in FIG. 3, to the locked position shown in FIGS. 1 and 2. The arm 175 of the coil spring 174 engages a second detent notch 78 in the locking lever part 141 to hold it in the locked position.

The locking mechanism further comprises inside and outside locking/unlocking actuator lock operating levers 80 and 82 and a plunger 89 (FIG. 1 in phantom) for pivoting the plastic first and second locking lever parts 141 and 142 back and forth between the locked (FIGS. 1 and 2) and unlocked (FIGS. 3 and 5) positions.

The inside lock operating lever 80 is pivotally mounted on the flange of the metal face plate 14 in front of the inside operating lever 56 for unlatching the door. It includes a tab 84 that engages in a claw slot 85 in one end of the plastic first locking lever part 141, so that the plastic first locking lever part 141 is pivoted clockwise from the unlocked position shown in FIG. 3, to the locked position shown in FIGS. 1 and 2, when the inside locking lever 80 is pivoted counterclockwise by an inside door lock lever or slide (not shown).

The first locking lever part 141 also has a claw slot 87 in the opposite end that is engaged by the plunger 89 of an electrically powered locking/unlocking actuator 91 so that the plastic first locking lever part 141 is also pivoted clockwise from the unlocked position shown in FIG. 3 to the locked position shown in FIGS. 1 and 2, when the plunger is to the position shown in FIGS. 1 and 2 by the electrically powered actuator 91. The electrically powered actuator 91 is controlled by a key lock cylinder (not shown) or one or more two way electrical switches (not shown) inside the vehicle passenger compartment.

The outside lock operating lever 82 is pivotally mounted on the stud 28 between the first locking lever part 141 and the face plate 14. The outside lock operating lever is often controlled by a suitable linkage (not shown) connected with a key cylinder. The outside lock operating lever 82 has a sector shaped cut-out 86 that receives an integral projection 88 of the first locking lever part 141. This forms a lost motion connection. The first lost motion connection is formed between the outside lock operating lever 82 and the first locking lever part 141 by the sector shaped cut-out 86 and the projection 88 so that the key and key cylinder can be returned to a neutral position after the first locking lever part 141 is rotated one way or the other.

Figure 6:
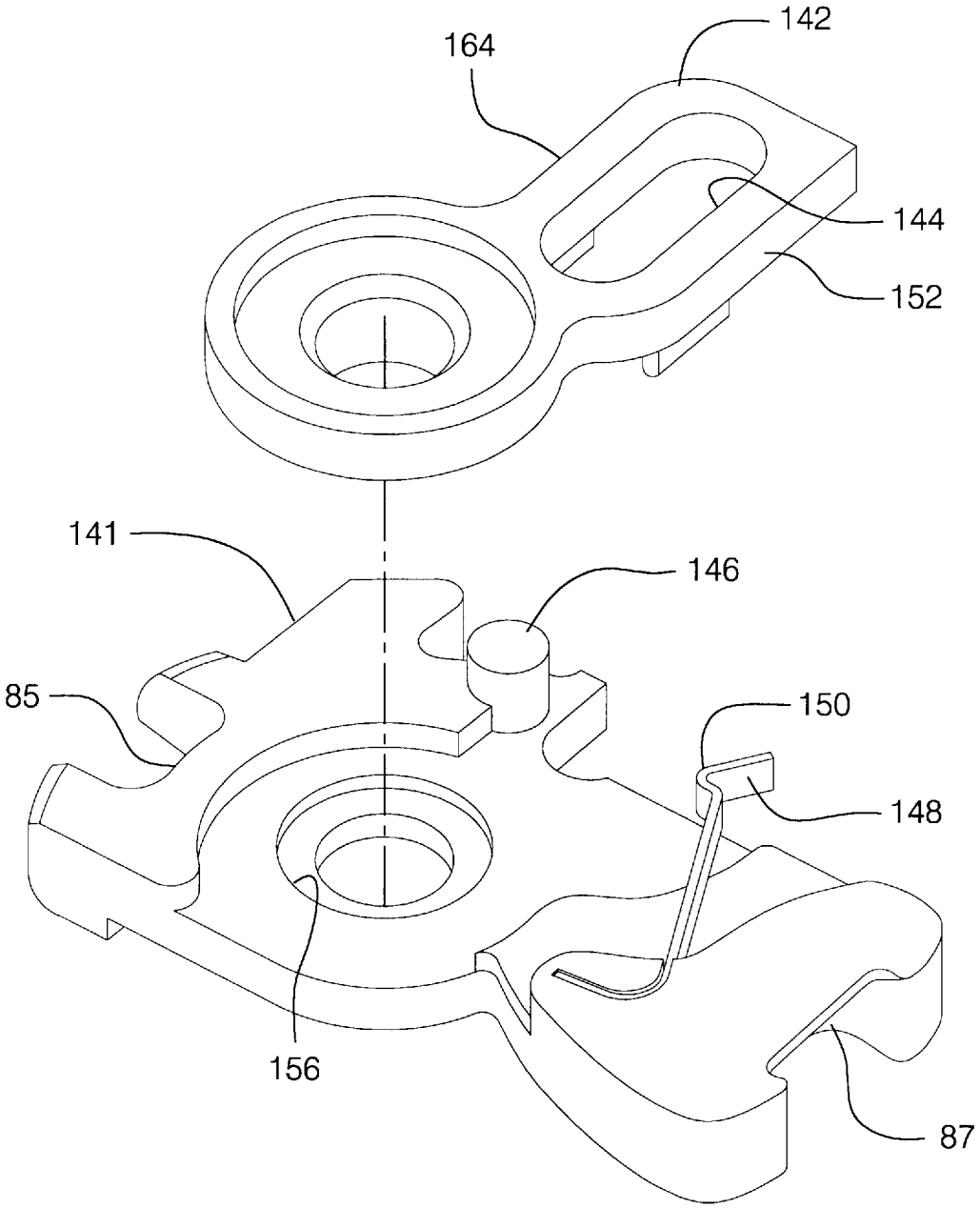
FIG. 6 is an exploded enlarged perspective view of the two part locking lever shown in the latches of prior FIGS. 1 through 5.

Referring primarily to FIG. 6, the first locking lever part 141 has a stop 146 which projects on a side of the first locking lever part opposite the integral projection 88. The first locking lever part 141 has embedded within it a leaf spring 148 which has a head 150 which rides against a surface 152 of the second locking lever part 142.

The second locking lever part 142 has an annular rim flange 154 (FIG. 7) which is fitted within an annular groove 156 of the first locking lever part 141. The first and second locking lever parts 141 and 142 pivot relative one another upon the stud 28. The second locking lever part 142 has two extreme pivotal positions with respect to the first locking lever part 141.

The leaf spring 148 biases the second locking lever part 142 toward its normal extreme pivotal position with respect to the first locking lever part 141 by forcing the shoulder or surface 164 to make contact with the shoulder or stop 146. The slot 144 of the second locking lever part 142 allows the second locking lever part to have both pivotal and translational movement with respect to the intermittent lever 34 by capturing the pivot pin 38.

A second extreme position of the second lock lever part 142 occurs when the first locking lever part 141 rotates counterclockwise relative the second lock lever part 142 as permitted by yielding of the leaf spring 148 to store energy thereon.

As mentioned previously, referring to FIG. 3, when the first locking lever part 141 is in the unlocked but latched position, clockwise rotation of the operator lever 50 caused by an input of an inside door handle via the inside operating lever 56 or the outside door release handle through a suitable linkage will cause the tab 54 to pull down the ear 46 to in turn pull down the rearward projecting tab 48 of the intermittent lever thereby causing the detent lever 32 to pivot clockwise and therefore release itself from the shoulder 60 of the fork bolt lever 30 thereby unlatching the vehicle door latch 7 and assuming the position shown in FIG. 5.

If the vehicle door latch 7 is in the locked and latched position shown in FIG. 2, and the outside operating lever 50 is rotated in a clockwise motion in an attempt to open the door, the ear 46 of the transfer lever will not contact the rearward extending tab 48 of the intermittent lever. Since the intermittent lever remains stationary, the detent lever 34 will not move away from contact with the shoulder 60 of the fork bolt lever and the vehicle door latch 7 remains in the locked latched position.

When a driver is seated inside the vehicle, the door latch 7 is unlocked from the locked and latched position of FIG. 2 by energizing the electrically powered lock/unlock actuator 91, which in turn pivots the first locking part 141 counterclockwise to its unlocked position of FIG. 1. Upon such rotation of the first locking lever 141, the leaf spring 148 carried thereby will push the second locking lever 142 in the counterclockwise direction so that the intermittent lever 34 will be swung clockwise about its pivot to once again establish the rearward extending tab 48 of the intermittent lever in readiness for engagement by the ear 46 of the transfer lever 44 when a passenger inside or outside the vehicle operates one of the door handles.

Figure 4:
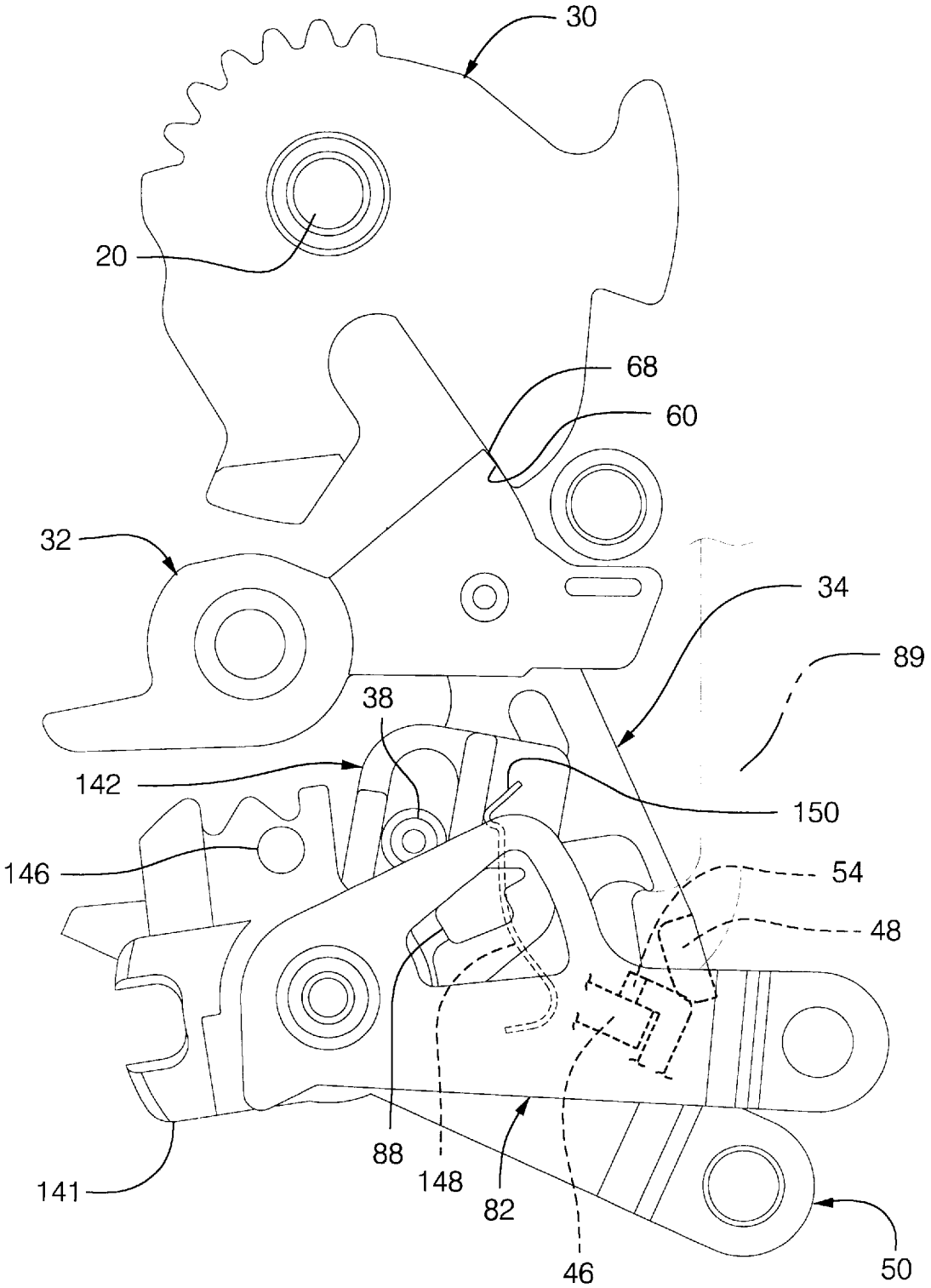
FIG. 4 is a view demonstrating interference between a tab of the intermittent lever and tabs of the transfer and operating levers when the vehicle latch is being moved from a locked latched position shown in FIGS. 1 and 2 to the unlocked and latched position shown in FIG. 3.

The present invention is particularly suited to a situation in which the passenger operates the door handle at the same time that the driver seated inside the vehicle energizes the lock/unlock actuator 91. As seen in FIG. 4, a passenger outside the vehicle has operated the outside door handle so that the tab 54 of the outside operating lever 50 has rotated the ear 46 of transfer lever 44 downwardly while the driver has simultaneously energized the lock/unlock actuator 91. The actuator 91 has rotated the first locking part 141 counterclockwise but the leaf spring 148 cannot force the second locking lever 142 to rotate counterclockwise because the second locking lever 142 coupled with the intermittent lever 34 is prevented from rotating by its rearward extending tab 48 being blocked by the tab 54 of outside operating lever 50 and ear 46 of the transfer lever as shown in FIG. 4. However, once the passenger outside the vehicle releases the outside handle 50, the ear 46 and tab 54 will withdraw from blocking the rearward extending tab 48 of the intermittent lever 34 so that the energy stored in the leaf spring 148 can then accomplish the counterclockwise rotation of the second locking lever 142 to in turn pivot the intermittent lever 134 clockwise to its unlocked position. Accordingly, any subsequent operation of the outside operating handle 50 will unlatch the door latch.

Prior to the present invention, the above noted interference would prevent the vehicle door latch 7 from being moved to an unlocked position. The door handle which was moving the outside operating lever 50 would have to be released and then a locking/unlocking actuator, be it the electric actuator, or exterior or interior door locking/unlocking actuators, would have to be reactivated to place the vehicle door latch in the configuration shown in FIG. 3. By splitting the locking lever into a first locking lever part 141 and a second locking lever part 142, the locking lever part 142 can pivotally move with respect to the first locking lever part. Therefore, as shown in FIG. 4, the interference between the intermittent lever rear extending tab 48 and the transfer lever ear 46 and/or tab 54 of the outside operating lever will not prevent the continued movement of the first locking lever part 141 to the unlocked position. Upon release of the door handle by the outside potential passenger, the leaf spring 148 will urge the second locking lever part 142 in a counterclockwise direction as shown in FIG. 4 to the position of FIG. 3. The outside potential passenger can then pull again on the outside door release handle and the vehicle door latch 7 will go from the unlocked latched position of FIG. 3 to the unlocked unlatched position of FIG. 5.

In all situations, when attempting to move the door latch 7 from the unlocked latched position of FIG. 3 to the locked latched position of FIG. 5, the stop 146 of the first locking lever part 141 will positively move the second locking lever part 142 clockwise to the position shown in FIG. 2.

Thus it is seen that the invention provides a new and improved door latch in which a two-part locking lever with a spring acting therebetween functions to assure unlocking of the door latch upon the first attempt by the driver, even if an impatient passenger has blocked the normal unlocking of the latch by impatiently operating the inside or outside handle without waiting for the driver to complete the unlocking of the door latch.

The invention has been described in an illustrative manner, and it is to be understood that the terminology which has been used is intended to be in the nature of words of description rather than of limitation.

Obviously, many modifications and variations of the present invention in light of the above teachings may be made. It is, therefore, to be understood that, within the scope of the appended claims, the invention may be practiced otherwise than as specifically described.

We claim:

1. A vehicle door latch operable between latched and unlatched conditions by at least one release handle and operable between locked and unlocked conditions by an inside actuable locking/unlocking actuator, comprising:

a fork bolt that is movable between a latched position and an unlatched position, the fork bolt having a latch shoulder;

a detent engageable with the latch shoulder of the fork bolt to hold it in the latched position;

an intermittent lever that is operatively connected to the detent for disengaging the detent from the latch shoulder of the fork bolt;

a transfer lever movable by the release handle and being engageable with the intermittent lever to move the intermittent lever and disengage the detent from the latch shoulder of the fork bolt;

a first locking lever operated between locked and unlocked positions by the inside actuable locking/unlocking actuator a second locking lever operatively connected to the intermittent lever to shift the intermittent lever between a normal unlocked position and a locked position in which the transfer lever is unable to engage the intermittent lever so that operation of the handle is unable to unlatch the latch;

interengaging shoulders on the first and second locking levers, the shoulder of the first locking lever engaging with the shoulder of the second locking lever to ensure shifting of the intermittent lever to the locked position upon movement of the first locking lever to the locked position by the locking unlocking actuator;

and a spring acting between the first and second locking levers to normally drive the second locking lever and shift the intermittent lever to the unlocked position upon movement of the first locking lever by the locking/unlocking actuator, and said spring yielding in the event that the intermittent lever is blocked from movement by premature operation of the transfer lever by the release handle so that the second locking lever is unable to shift the intermittent lever whereby energy is stored in the spring to subsequently move the second locking lever to an unlocked position and shift the intermittent lever when the intermittent lever becomes unblocked.

2. The door latch of claim 1 further characterized by the first and second locking levers being pivotally mounted on a common pivot shaft.

3. The door latch of claim 2 further characterized by the spring being a leaf spring carried by the first locking lever and bearing on the second locking lever.

* * * * *